United States Patent [19]

Spriggs

[11] 4,311,656

[45] Jan. 19, 1982

[54] METHOD FOR REPAIRING EXTENSIVE DAMAGE TO PLASTERBOARD WALL AREAS

[76] Inventor: William A. Spriggs, 128 Toldeo La., Willingboro, N.J. 08046

[21] Appl. No.: 180,217

[22] Filed: Aug. 21, 1980

[51] Int. Cl.[3] ..... B32B 35/00

[52] U.S. Cl. ..... 264/36; 52/514; 156/98; 264/35; 264/273; 427/140

[58] Field of Search ..... 264/36, 35, 273; 52/514; 156/98; 427/140

[56] References Cited

U.S. PATENT DOCUMENTS

| | | | |
|---|---|---|---|
| 2,598,194 | 5/1952 | Shippey | 52/514 |
| 4,100,712 | 7/1978 | Hyman | 52/514 |
| 4,152,877 | 5/1979 | Green | 52/514 |
| 4,193,243 | 3/1980 | Tiner | 52/514 |

*Primary Examiner*—Donald E. Czaja
*Assistant Examiner*—W. Thompson
*Attorney, Agent, or Firm*—John J. Kane; Frederick A. Zoda; Albert Sperry

[57] ABSTRACT

A method is disclosed for the repairing of extensive damage to plasterboard areas wherein wet plaster will normally not hold in such a large repair area. The method includes the cutting through the paper surface layer of the plasterboard material in an approximately circular shape around the damaged area. The exposed plaster of the plasterboard can then be sanded by such a tool as a power rotating sander such that the plaster within the plasterboard is removed to a predetermined depth. A plate member having a thickness less than this predetermined dimension and preferably on the order of 0.014 inches is then placed over the damaged area within the removed plaster area. This plate member is fixedly secured to the undamaged area of the plasterboard within the defined circular area. The plate member is preferably perforated throughout for ventilation and securement of plaster thereto. Wet plaster is then placed into the predetermined area into contact with the plate member and the undamaged area within the defined area. This plastering is then treated by sanding or the like in a conventional manner such that a smooth surface with the surrounding wallboard area is formed. In this manner a surface to which the plaster will adhere is provided over the extensively damaged plasterboard area.

12 Claims, 6 Drawing Figures

METHOD FOR REPAIRING EXTENSIVE DAMAGE TO PLASTERBOARD WALL AREAS

BACKGROUND OF THE INVENTION

1. Field of the Invention

The present invention deals with the field of repair of walls. The present invention is particularly useful for walls which are made from plasterboard material as is in current wide usage. Such plasterboard material basically comprises hardened plaster mounted between a front and rear surface sheet of paper. The paper maintains the sheet configuration of the otherwise brittle plaster and facilitates usage.

The present invention provides a novel method for the repair of such plasterboard surfaces but is also useful for the repair of standard plaster-type walls. A difficulty arises when a substantial damage is done to a plasterboard or plaster wall on the order of anything larger than an aperture of one or two inches. Such substantial damage requires an extraordinary means for maintaining wet plaster in place such that it can dry and be sanded or otherwise finished to a smoothness with respect to the surrounding wall area. The present invention provides a novel method usable with a plate-type member for providing a surface to which such wet plaster can adhere during the time of drying.

2. Description of the Prior Art

Prior art devices are known to the applicant specifically as shown in U.S. Pat. Nos. 2,598,194; 4,100,712; 4,152,877 and 4,193,243. Each of these patents discloses an approach to the formation of a bridge across an extensive damage to a plaster wall such that wet plaster can adhere in the hole. The present invention is distinguishable from these pluralities of designs in its simplicity and ability to be used with a great variation of types of wall damages.

SUMMARY OF THE INVENTION

The present invention provides a novel method for the repairing of extensive damage to wall areas of plasterboard. This novel method comprises the initial cutting through the normally paper surface layer of a plasterboard material in an area defined surrounding the damaged area. This cutting should be of a sufficient depth to cut the surface area and specifically a paper surface area of the wall plaster or plasterboard material. This surface layer is removed in a defined area surrounding the damaged area.

This defined area is then sanded in any conventional manner such as with a power rotating sander in order to form a generally cylindrically defined area around the damaged area. This sanding is performed to a depth less than the full thickness of the plasterboard material itself such that a portion of sanded down yet undamaged plaster area is remaining. The depth of this sanding will be somewhat greater than the thickness of the plate member which will be inserted therein.

A plate member is then placed into this defined area. The plate member will be of a thickness less than the depth of the sanding in the defined area. This plate member may be circular or square or any predetermined geometric shape and it defines a plurality of apertures or holes therein which may be of any size but have been shown to preferably be 3/32nds of an inch or 0.09325 inches. This plate member will extend over the entire damaged area and will have attachment areas thereof extending in the defined area such as to be in contact with the undamaged area therein. These attachment areas of the plate member will be capable of being secured with respect to the undamaged areas of the plasterboard within the defined area by any convenient securing means but preferably by means of a flathead screw being screwed therethrough into the plaster therebelow.

At this point an overall configuration will be achieved wherein an aperture has been cut into the plaster and a plate member has been secured therein completely covering the damaged area. This plate member will have a plurality of apertures. With this configuration it is now possible to provide a normal plastering operation to fill the aperture sanded out and also fill over the damaged area of the wall. This standard plastering operation will include repeated layers of plaster in thin coats to build up the wall area to a height approximately equal to the surrounding area such that the damaged area is unnoticeable. Securement between the wet plaster and the perforated plate member will be facilitated by the plurality of perforations or apertures defined therein as the plaster is urged into the defined area it will tend to sqirt slightly through the apertures and facilitate securement of the repaired area.

Preferably the plate member is on the order of 0.014 inches in thickness such that minimal sanding within the defined area of the undamaged wall area is necessary. In alternative configurations a separate outer annular member can be included integral with the plate member which does not include perforations therein and only includes apertures therethrough to facilitate securement.

It is an object of the present invention to provide a novel method for the repairing of areas of extensively damaged plasterboard and plaster walls.

It is an object of the present invention to provide a novel method for repairing extensive damage to plasterboard including the removal of the paper surface area of the plasterboard material in a predefined area surrounding the damaged area.

It is an object of the present invention to provide a novel method for the repairing of extensively damaged areas of plasterboard including the sanding of the plasterboard around the damaged area below the surrounding surface area.

It is an object of the present invention to provide a novel method for the repairing of extensively damaged areas of plasterboard which is particularly useful for areas of approximately one to two inches or greater.

It is an object of the present invention to provide a novel method for the repairing of extensively damaged areas of plasterboard including the securement of a circular plate member over the damaged area wherein the plate member may be of a tin or plastic material.

It is an object of the present invention to provide a novel method for the repairing of extensively damaged areas of plasterboard and plaster which makes use of conventionally available tools and as such is particularly useful for homeowners.

It is an object of the present invention to provide a novel method for the repairing of extensively damaged areas of plasterboard which minimizes the number of applications of surfacing plaster which must be made over such extensively damaged areas.

It is an object of the present invention to provide a novel plaster wallboard repair method which facilitates the drying of plaster by providing an adhering surface which includes a plurality of apertures or orifices therein.

It is an object of the present invention to provide a novel method for repairing of extensively damaged areas of plasterboard which includes a plate for placement over the damaged area wherein the plate includes a plurality of apertures therein to facilitate gripping between the plaster and the plate.

It is an object of the present invention to provide a novel method for the repairing of extensively damaged areas of plasterboard which is particularly useful where the rear surface of the wall is inaccessible.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
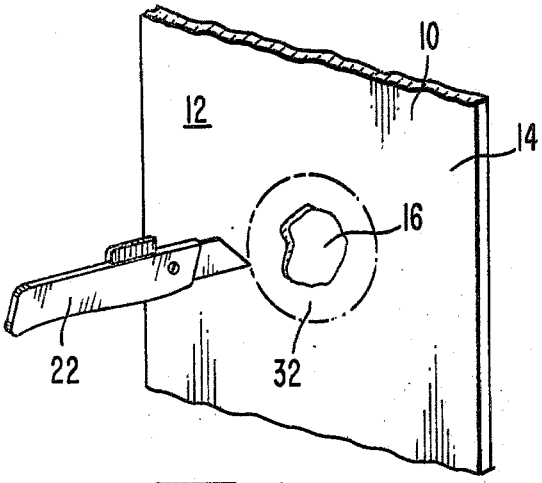
FIG. 1 is an illustration of an embodiment of the present invention showing the first step of cutting the defined areas.
Figure 2:
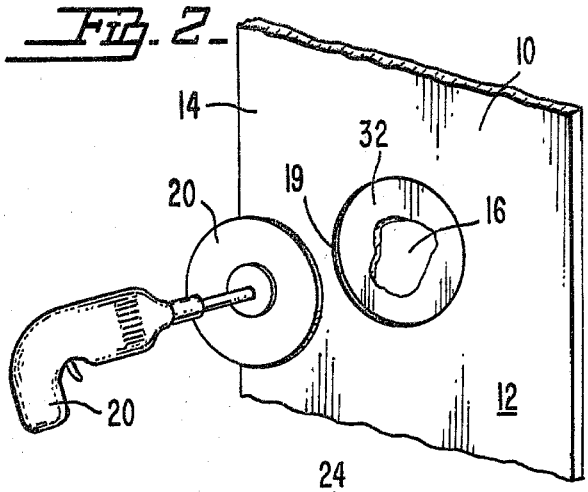
FIG. 2 is an illustration of an embodiment of the present invention showing the step of sanding the defined area to a predetermined depth.
Figure 3:
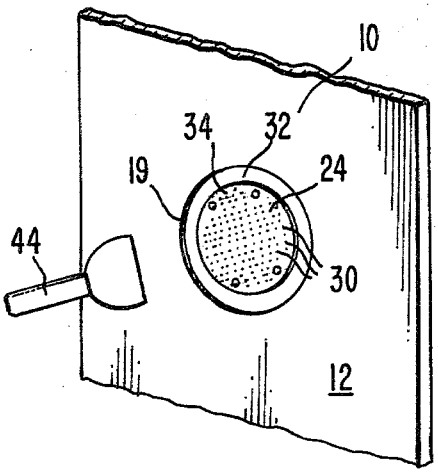
FIG. 3 is a perspective view of an embodiment of the present invention showing a circular plate member fixedly secured within a defined area.

The present invention provides a novel method for the repairing of extensive damage to wall areas 12 particularly where those areas are of plasterboard 10. However, the present invention is also usable with respect to those walls of plaster.

The method of the present invention is useful for those types of damage which are large enough in nature such as to prevent the holding of wet plaster therein as it dries in order to fill the damaged area. Such damage is normally on the order of one to two inches in diameter or larger. As shown in the FIGS. 1 through 3 and FIG. 6 the present invention contemplates the cutting of the paper surface area 14 of plasterboard material in an area defined surrounding the damaged area. This cutting should be performed deep enough such that the paper surface of the plasterboard or the surface layer of the plaster is removable. Upon removal of the surface layer material a defined area surrounding the damaged area 16 will be created. This defined area 18 is preferably circular but can take any shape.

Normally this defined area will be chosen to be round and of a size equal to a sanding disc of a powered sanding device 20. This is preferable since the next step comprises the removing of a surface layer of the plaster material in this area which has been defined by the cutting with cutting devices 22 of the paper surface. This sanding is performed on the surrounding undamaged area to a predetermined depth 19. This predetermined depth only must be greater than the thickness of a plate member which will be placed therein. It is also necessary that this sanding be performed to a predetermined depth 19 which is less than the thickness of the wall area itself such that some material is left in the undamaged area 32 within the defined area to which the plate 24 can be secured.

A plate 24 preferably will be circular and will be of a thickness of approximately 0.014 inches. Any convenient thickness 26 can be used for the plate, however, it must be less than the predetermined depth 19 achieved by the power sanding operation.

While the plate may be circular as shown in plate 24 a square plate 28 could also be used, however, the circular shape has been preferred merely because the sanding operation will generally render a circular hole. Regardless, both the square plate 28 and the circular plate 24 will include a plurality of apertures of perforations 30 through the surface thereof. These apertures may be on the order of 3/32nds of an inch. The purpose of these perforations is two-fold. Firstly the apertures provide an irregular surface to which wet plaster can adhere. Secondly, the apertures provide additional drying to facilitate hardening of the wet plaster.

Figure 4:
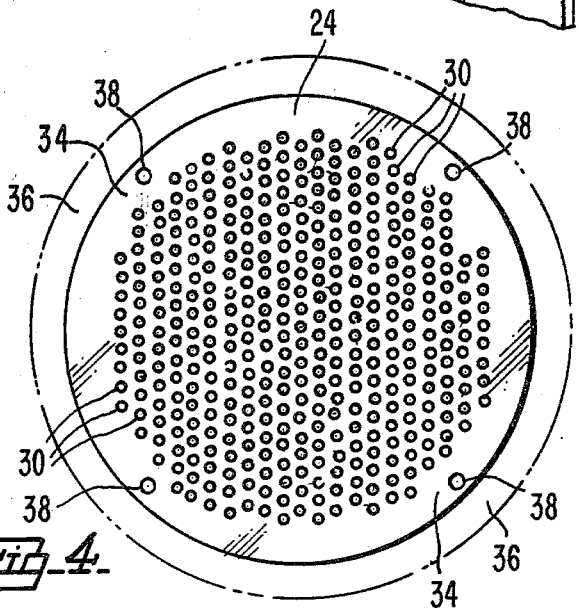
FIG. 4 is a plan view of an embodiment of a circular plate member of the present invention.
Figure 5:
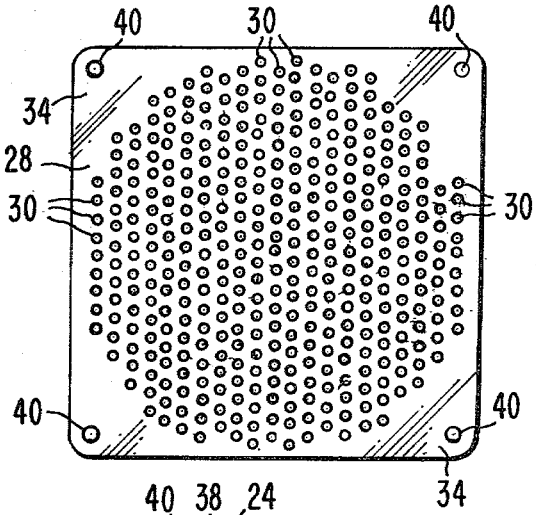
FIG. 5 is a plan view of an embodiment of a square plate member of the present invention.

The plate itself will be attached to the undamaged area 32 within a defined area 18. For that purpose an attachment area 34 of the plate is defined having a plurality of securement apertures 40 defined therein. This attachment area can take any configuration but could be an annular attachment area particularly as shown in the dotted outline in FIG. 4. The plate shown in FIG. 4 can be as shown in full line drawing or can be somewhat larger such that it includes an annular unperforated edge around the outside, wherein that annular area only includes securement apertures 40 and does not include any perforation therein designed for drying or securement of the wet plaster thereto. Regardless of the configuration of the attachment area 34 a plurality of flathead screws 38 may be used to extend inwardly through the securement apertures 40 such that they can fixedly secure the plate 24 or 28 with respect to the undamaged area 32 within the defined area 18. In this manner a firm securement between the plate and the undamaged area of the wall will be achieved.

At this point, a surface is provided to which the wet plaster 42 will adhere when it is placed into the damaged area by the use of conventional means such as a putty knife 44.

The present invention is particularly novel in the aspect of removing an amount of undamaged wall area immediately adjacent to the wall area to provide a securement location for a plate which will extend over the damaged area and provide a surface to which the plaster 42 can adhere. Also, the present invention makes no use of any equipment not ordinarily available to the average homeowner and merely requires the purchase of a plurality of plates which may be of any particular size normally on the order of four to six inches.

Figure 6:
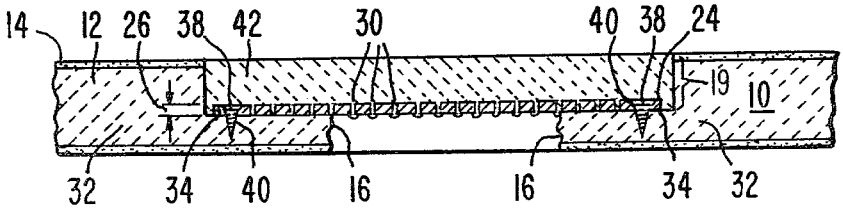
FIG. 6 is a cross-sectional view of a repaired wall section wherein an embodiment of the present invention has been utilized to repair an extensively damaged area.

The final configuration is shown in FIG. 6 with the plate 24 secured into the bottom of the defined area 18 and with the plaster 42 shown as having slightly oozed through the perforations 30 defined in the plate. The flathead screws 38 are shown securing the plate to the undamaged area 32 within the defined area 18.

While particular embodiments of this invention have been shown in the drawings and described above, it will be apparent that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A method for repairing extensive damage to plasterboard wall areas comprising:

(a) cutting the surface of the plasterboard material in an area defined surrounding the damaged area to a depth sufficient to perforate the surface layer thereof;

(b) removing the surface layer of plasterboard material in the defined area surrounding the damage area;

(c) sanding the defined area around the damaged area to a predetermined depth less than the complete thickness of the plasterboard material itself;

(d) placing a plate member, defining a plurality of apertures therein, into the defined area extending completely over the damaged area with attachment areas thereof extending over the undamaged area within the defined area, the plate member being of a thickness less than the predetermined depth of said sanding;

(e) securing the attachment area of the plate area of the undamaged area of the plasterboard material within the defined area;

(f) placing wet plaster to a depth greater than the predetermined depth into the defined area over the undamaged area of the plasterboard and over the plate member including through perforations defined therein to facilitate securement of the plaster material thereto upon drying;

(g) drying of the wet plaster placed within the damaged areas; and (g) sanding the dried plaster within the defined area to a level approximately equal to the surrounding plasterboard.

2. The method as defined in claim 1 wherein said sanding is performed by a rotating power sander to form a circular defined area.

3. The method as defined in claim 1 wherein said securing comprises screwing, through a securement aperture defined in the attachment area of the plate, into the undamaged area within the defined area.

4. The method as defined in claim 3 wherein said screwing is performed with a flathead screw.

5. The method as defined in claim 1 wherein the surface of the plasterboard material is a paper layer and said cutting thereof is performed completely through the paper layer.

6. The method as defined in claim 1 wherein the predetermined distance is greater than 0.014 inches.

7. The method as defined in claim 6 wherein the plate member is approximately 0.014 inches.

8. The method as defined in claim 1 wherein the plate is circular in shape.

9. The method as defined in claim 8 wherein the attachment area of the plate is an unperforated outermost annular area.

10. The method as defined in claim 1 wherein the plate is square in shape.

11. The method as defined in claim 1 wherein the perforations are approximately 0.09375 inches each in diameter.

12. A method for repairing extensive damage to wall areas of plasterboard having a paper surface layer thereon comprising:

(a) cutting through the paper surface layer of the plasterboard material in an area defined surrounding the damaged area to a depth sufficient to perforate the surface layer thereof;

(b) removing the surface layer of plasterboard material in the defined area surrounding the damaged area;

(c) sanding with a rotating power sander to form a circular defined area around the damaged area to a depth greater than 0.014 inches which is less than the complete thickness of the plasterboard material itself;

(d) placing a circular plate member, defining a plurality of apertures therein of approximately 0.09375 inches, into the defined area extending completely over the damaged area with attachment means thereof extending over the undamaged area within the defined area, the plate member being of a thickness of 0.014 inches.

(e) securing the attachment area of the plate member to the undamaged area of the plasterboard material within the defined area by screwing with a flathead screw through securement apertures defined in the attachment area of the plate, into the undamaged area within the defined area;

(f) placing wet plaster to a depth greater than the predetermined depth into the defined area over the undamaged area of the plasterboard and over the plate member including through perforations defined therein to facilitate securement of the plaster thereto upon drying;

(g) drying of the wet plaster placed within the undamaged area; and (h) sanding the dried plaster within the defined area to a level approximately equal to the surrounding plasterboard.

* * * * *